US009316452B2

(12) United States Patent
Assis

(10) Patent No.: US 9,316,452 B2
(45) Date of Patent: Apr. 19, 2016

(54) REVOLVER WITH TWO CHAMBERS CYLINDER

(71) Applicant: Forjas Taurus S.A., Porto Alegre (BR)

(72) Inventor: Anderson da Silva Assis, Porto Alegre (BR)

(73) Assignee: Forjas Taurus S.A., Porto Alegre (BR)

( * ) Notice: Subject to any disclaimer, the term of this patent is extended or adjusted under 35 U.S.C. 154(b) by 0 days.

(21) Appl. No.: 14/717,539

(22) Filed: May 20, 2015

(65) Prior Publication Data

US 2015/0338177 A1 Nov. 26, 2015

(30) Foreign Application Priority Data

May 20, 2014 (BR) ..... 10 2014 012136-6

(51) Int. Cl.
*F41A 3/14* (2006.01)
*F41C 3/14* (2006.01)

(52) U.S. Cl.
CPC .... *F41A 3/14* (2013.01); *F41C 3/14* (2013.01)

(58) Field of Classification Search
CPC ..... F41C 3/14; F41C 3/16
USPC ..... 42/59, 62
See application file for complete search history.

(56) References Cited

U.S. PATENT DOCUMENTS 84,976 A * 12/1868 Wesson ..... F41A 9/28 42/59

FOREIGN PATENT DOCUMENTS

| | | |
|---|---|---|
| DE | 114184 | 8/1899 |
| GB | 22479 | 0/1900 |
| NO | 8564 | 4/1899 |

OTHER PUBLICATIONS

Landstand 1900 Automatic Revolver, (Jun. 22, 2015), Retrieved from http://www.forgottenweapons.com/landstad-1900-automatic-revolver/.

* cited by examiner

*Primary Examiner* — Reginald Tillman, Jr.
(74) *Attorney, Agent, or Firm* — The Webb Law Firm

(57) ABSTRACT

Provided is a revolver with a two chambers cylinder, of the type having a low profile and with no protruding parts from the frame. The revolver includes a frame which has a grip at its rear portion, a trigger at its lower portion and a barrel at its front portion. The frame further includes a central opening that defines the cylinder housing. The cylinder has an oblong shape and has two chambers, radially opposite with respect to the rotation axis of the cylinder. The cylinder rotation before firing is obtained by means of the trigger actuation, which causes an upward movement of the cylinder impeller and the consequent rotation of the gear, due to interaction between the pinion and the teeth of the cylinder impeller. The transfer of the rotational movement of the gear to the cylinder is made from a ratchet, which is partially arranged within said cylinder.

5 Claims, 5 Drawing Sheets

REVOLVER WITH TWO CHAMBERS CYLINDER

CROSS-REFERENCE TO RELATED APPLICATION

This application claims priority to Brazilian Patent Application No. 10 2014 012136-6 filed May 20, 2014, the disclosure of which is hereby incorporated in its entirety by reference.

BACKGROUND OF THE INVENTION

1. Field of the Invention

The present invention relates to a light weapon, such as a revolver, with a two chambers cylinder, i.e., a revolver whose cylinder has two ammunition housings opposed one another in 180 degrees and with elongated profile, as well as to the corresponding rotation mechanism of the cylinder.

2. State of the Art

It has been well-known in the art some light weapons, historically called "Deringer", which are defined as very small size revolvers usually of low caliber. The main purpose of this kind of weapon was enabling it to be carried without annoying the users and especially not to allow its detection by others. Usually, these weapons were designed to operate in short range, for both salons poker players and women.

Among these weapons, one particular configuration can be notice in the revolver produced by Frank Wesson in the year of 1868 and the next ones. Such a revolver had a cylinder with only two chambers or housings, being the rotation thereof made in a manual way by the user. The advantage of this revolver was its reduced width, since the cylinder width was similar to the width of the gun body.

The Norwegian patent number NO 8564 of Apr. 11, 1899 discloses a gun with cylinder having two chambers and the ammunition storage located at the gun grip. The loading of the gun occurs from the cartridges previously arranged in a magazine attached inside the grip/gunstock, and these cartridges advance by the action of a spring. Each cartridge is fed within the lower chamber and rises to the firing position due to a 180-degree rotation of said cylinder. After firing the weapon, the fired capsule is ejected from the mobile bolt recoil, similar to that seen in modern guns. When the upper chamber of the cylinder is released, then a new 180-degree rotation thereof occurs, whereby a new cartridge is positioned for firing position. Due to its functional characteristics, such automatic revolver, as indicated by its inventor, could be classified as a single action pistol provided with a rotating cylinder. Furthermore, the firing and loading mechanism is quite complex and is based on a pair of springs, one of them arranged in the gun bolt and another, lower, in the body of the gun.

Accordingly, it is an object of the present invention a revolver of the type light weapon, comprising a cylinder provided with two radially opposite chambers, with a reduced size, and especially providing a cylinder rotating mechanism more efficient and reliable.

SUMMARY OF THE INVENTION

The above mentioned objects are achieved from a revolver provided with a two chambers cylinder, of the type that has a low profile and with no protruding parts from the frame, said revolver comprising a frame provided with a grip at its back portion, with a trigger at its lower portion and with a barrel at its front portion, wherein said frame further comprises a central opening that defines the cylinder housing, said cylinder having an oblong shape and having two chambers radially opposite with respect to rotation axis of the cylinder, comprising: the trigger is provided with an arm at its front portion and, from said arm, transversely, projects a shaft of the impeller; an impeller having the form of a longitudinal bar shaped with displacement of the vertical direction, having, on the bottom, a cradle to receive and articulate the impeller shaft, and teeth arranged at the upper portion of the impeller able to gear the teeth of a pinion; a gear co-axial with respect to the cylinder rotation axis, defining, at its rear portion, a pinion and, at its front portion, a pair of slopes inclined and radially opposite to one another and arranged internally to the divergent conical portion of the gear; a ratchet co-axial with respect to the rotation axis and inwardly disposed relative to the cylinder, said ratchet having a cylindrical shape, externally provided with longitudinal teeth for coupling in rotation, but not in longitudinal translation, with the cylinder, wherein the end of the ratchet, facing the gear, has a pair of complementary slopes to those of gear slopes; and a cylinder comprising a central longitudinal opening, wherein from the front end of said central longitudinal opening is arranged, inside the cylinder, the cylinder shaft and, from the rear end of said central longitudinal opening is arranged a ratchet and wherein, between the cylinder shaft and the ratchet is provided a spring.

BRIEF DESCRIPTION OF DRAWINGS

The object of the present invention will be better understood from the detailed description of a preferred and non-limiting embodiment of the invention taken in relation to the attached figures, in which.

PREFERRED EMBODIMENT OF THE INVENTION

Figure 1:
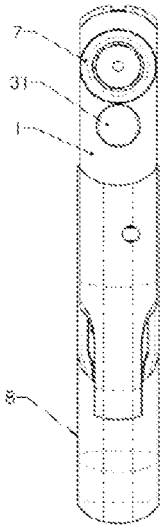
FIG. 1 is a front view of the revolver of the present invention.

In accordance with the attached drawings, FIG. 1 illustrates a revolver, according to the present invention, the width of which is substantially reduced in comparison with the known revolvers provided with six-cartridges cylinder. Such a configuration allows that the revolver of the invention can be carried discreetly and, thus, not revealing its presence. Moreover, it small profile and without protrusions facilitates the handling of the gun, as well as pulling and storing thereof.

More particularly, said revolver comprises a frame (1), which houses and supports the several components of the revolver, i.e., cylinder (2), trigger (3) and grip (8), among others.

More particularly and in a known manner, the frame (1) is basically composed of a breech or rear portion, provided to house the spring (17) and to receive externally the grip (8); a central opening which defines the cylinder housing (2); a recess provided for, between said breech and said central portion, receiving the hammer (9) and the components that connect the spring (17) to the trigger (3); and a front hole for receiving the barrel (7).

In the illustrated embodiment, the concept applied to the revolver of the invention is a lightweight weapon and with reduced dimensions; it is why said barrel (7) is almost fully inserted into the front portion of the frame. However, in other embodiments the barrel (7) may have a greater length than its frame (1) bore seat thus protruding beyond said frame (1).

Figure 2:
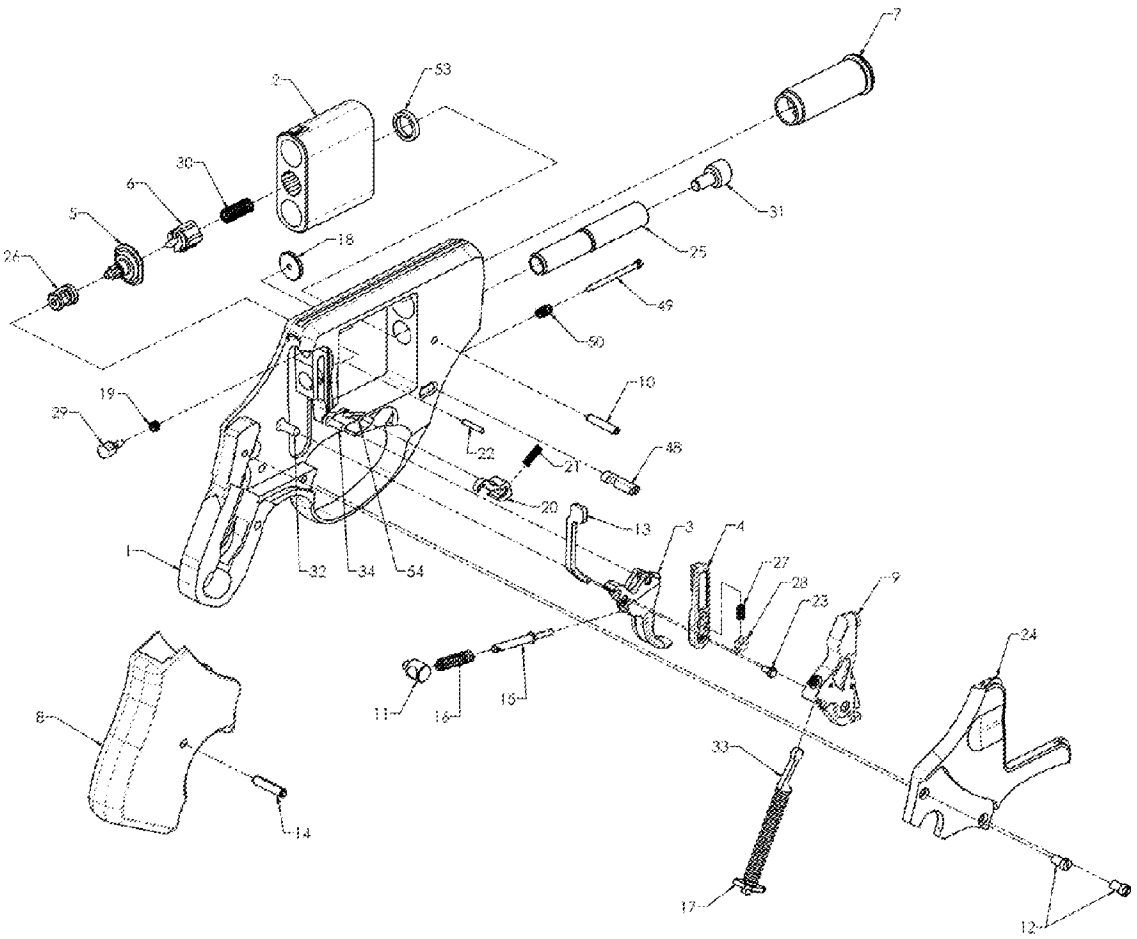
FIG. 2 is an exploded perspective view of the revolver of FIG. 1.
Figure 3:
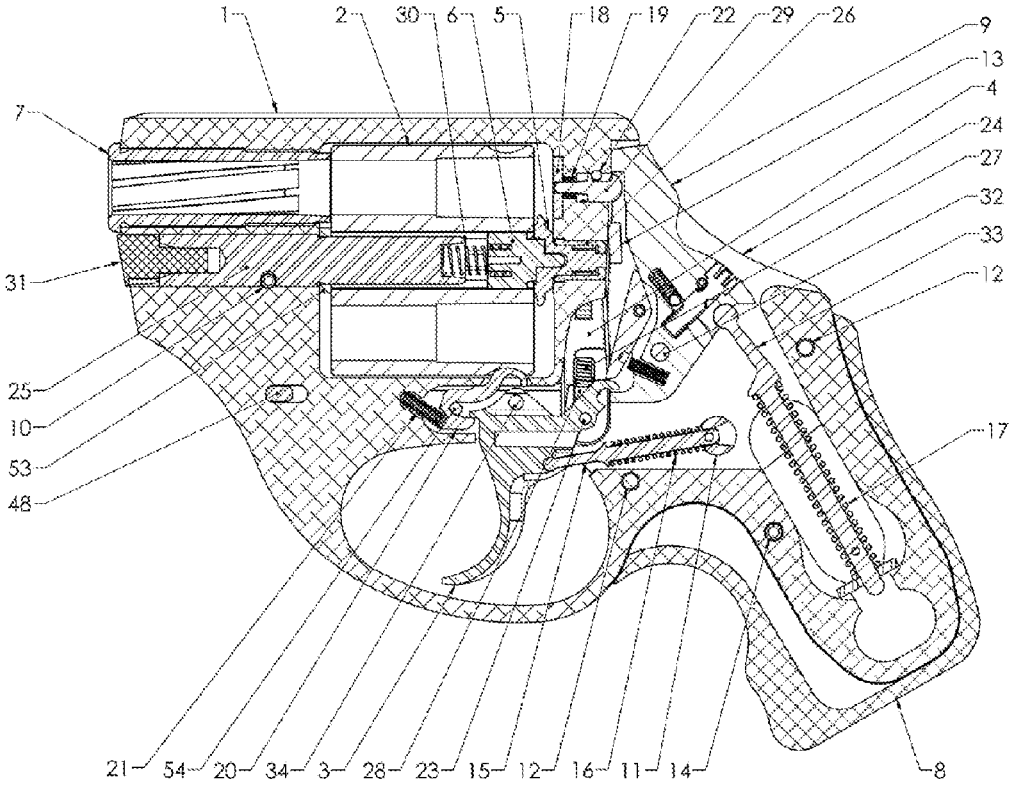
FIG. 3 is a side elevation and sectional view illustrating the arrangement of the mechanisms of the gun.
Figure 5A:
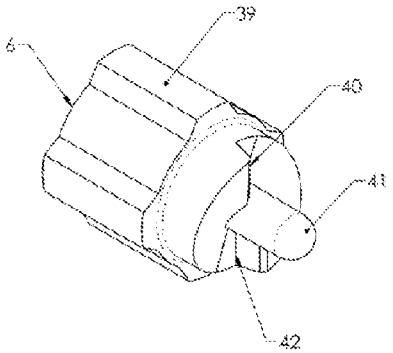
FIGS. 5A to 5C are views of the ratchet, respectively, in perspective, in front elevation and in cross section.
Figure 5B:
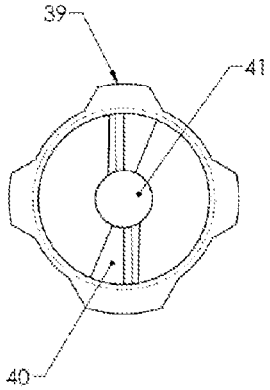
Figure 5C:
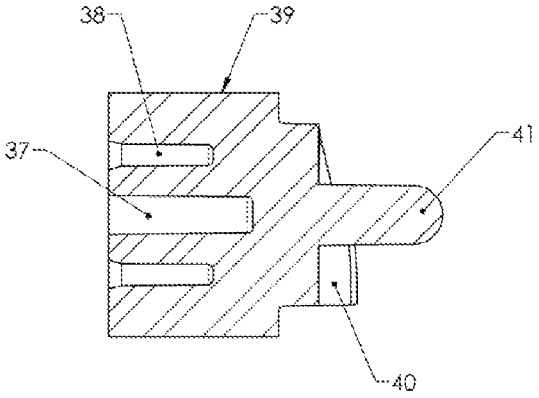

In a known manner and with particular attention to FIGS. 2 and 3, the hammer (9), or the hammer assembly itself is pivoted with respect to the frame (1) around the hammer axis (32) and it is boosting by the spring (17) provided inside the breech. Therefore, the rod (33) of the spring (17) is kept in contact with the rear portion of the hammer (9). The trigger (3) is also pivoted with respect to the frame (1) around the trigger axis (34) and against the spring action (16). In the front portion of the trigger (3) is provided an arm (35) whose protruding end defines a tooth acting against the lower portion of the hammer (9), and wherein said arm (35) further has a transverse projection defining the impeller shaft (23).

According to the present invention and with particular attention to FIGS. 2 to 5, the cylinder (2) is arranged in the opening of the frame (1), so that its upper chamber is perfectly aligned both with the barrel (7) and the firing pin (29). To this end, said cylinder (2) is supported and is able to rotate around the shaft (25) arranged in a through hole of the frame (1) below the barrel (7). More in particular, said shaft (25) is held in position inside the hole of the frame (1) by means of the elastic pin (10). The front opening of the frame's hole (1) is closed by a fitting cover (31) in order to obtain an aesthetic closure and prevent accumulation of particles in the hole. Therefore, after removing the cover (31) and the elastic pin (10), it is possible to remove the shaft (25) of the frame (1).

At the rear end of the shaft (25), opposite to the front end which receives the cover (31), said shaft (25) has a flat surface on which acts a spring (30) in a compressed condition, wherein the spring (30) acts forcing the relative detachment between the shaft (25) and the ratchet (6).

Regarding to said ratchet (6), it has a generally cylindrical conformation with a flat front end and provided with an annular seat (38), able to receive and support said spring (30).

Figure 8A:
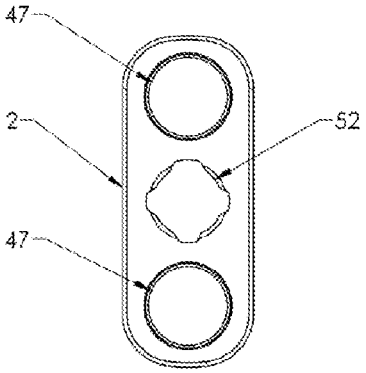
FIGS. 8A and 8B are views of the cylinder, respectively, in front elevation and in cross-section.
Figure 8B:
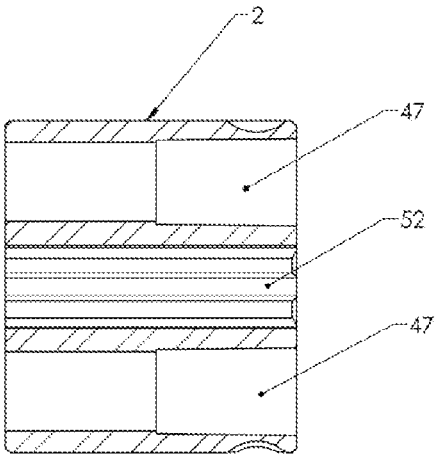

Externally, said ratchet (6) has several longitudinal teeth (39) which engage corresponding grooves (see FIGS. 8A and 8B) provided inside the cylinder (2), so as the rotational requests received from the ratchet are transmitted to the cylinder (2), while the ratchet (6) is free to move freely and independently in the longitudinal direction with respect to the cylinder.

Figure 6A:
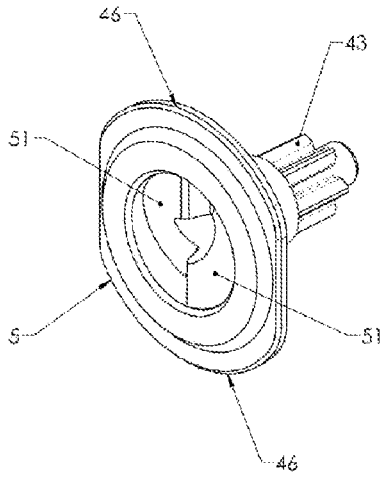
FIGS. 6A and 6B are views, respectively, in perspective and in cross-section of the rotation gear of the cylinder.
Figure 6B:
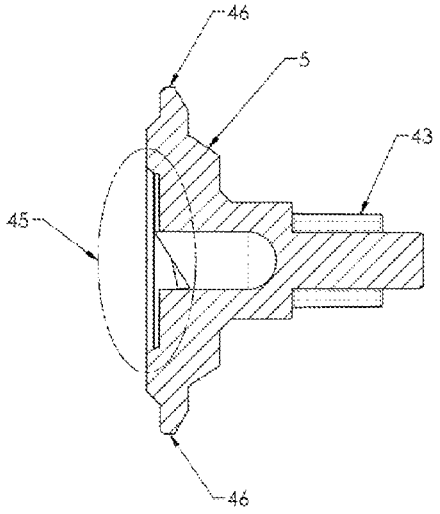

Finally, the rear portion of the ratchet defines a pair of slopes (40), in the form of a crown, which surround a central pin (41). Said slopes (40) are separated from one another by two recesses (42) of straight side walls, which define two final rotational courses for the ratchet (6) and gear (5), each said final course being displaced 180 degrees relative to each other. Furthermore, the said central pin (41) of the ratchet is provided to enter into a corresponding central hole (see FIG. 6B) of the gear (5), so that the length of said central hole is larger than the relative longitudinal displacement between the ratchet and the gear (5), due to mechanical interference between the corresponding slopes (40, 51). Consequently, the longitudinal centering between the ratchet (6) and the gear (5) is maintained, whatever the relative position between thereof.

Said gear (5) is co-axial with respect to the shaft (25) and the ratchet (6) (see FIG. 2) is externally based on a bearing in a hole of the frame (1), wherein the bearing (26) is inserted, and thus it is designed to convert the linear movement of the impeller (4) into a rotational movement of the ratchet (6). Because the bearing (26) is fixed with respect to the frame (1), the gear (5) is free to rotate, but it cannot translate along its longitudinal axis. More particularly, said gear (5) has a rear end provided with teeth in form of a pinion (43), wherein said pinion, in the weapon assembled condition, is arranged within the bearing (26) and is able to engaging the teeth (44) of the impeller (4) (see FIG. 4A). The front end of the gear (5) has a divergent configuration, defining a front flat surface and provided to hold the cylinder (2) in the advanced position and also defines a seat (45) for engagement with the ratchet (6). Said gear (5) seat (45) has two slopes (51) with equal inclination to the slopes (40) of the ratchet (6), so that, when the trigger (3) is moved backward (starting the gun shooting action), the impeller (4) engaged to the trigger (3) by the shaft (23) is raised, causing a rotation in the counterclockwise direction (according the gun position seen from who wields it) of the gear (5); in this rotating condition, said gear (5) is coupled to the ratchet (6), so as to cause a rotation angularly equivalent in said ratchet (6). According to the invention, the dimensions of the impeller (4) teeth and pinion (43) are such that said rotation is 180 degrees. On backward way, i.e., after the gun firing, the trigger (3) automatically goes back (by action of the spring (16)) to its advanced position, so that the impeller (4) is lowered (as the illustrated position in FIG. 7). The lowering of the impeller (4) entails a clockwise rotation of the gear (5), causing the sliding of the gear slopes (51) with respect to slopes (40) of the ratchet (6), wherein the ratchet (6) does not undergo any rotational movement but is advanced longitudinally against the action of the spring (30). Finished the gear (5) rotation, the slopes (40) of the ratchet (6) lose contact with the gear (5), whereby the spring (30) acts by moving the ratchet (6) backwards and in coupling with said gear (5).

The operation of the revolver mechanism, according to the present invention, works as per the following illustrative steps:

Rotation of the Cylinder

In order to achieve that the cylinder (2) rotates 180°, has designed a mechanism like gear rack, wherein the rack's function is performed by the impeller (4). The impeller (4) has the function to convert the angular motion of the trigger (3) into linear motion and actuates the gear (5) (which is bearing on the bear (26)) and it converts the linear movement into a circular motion, resulting in a 180° cylinder (2) rotation.

Actuation of the Mechanism

Once pulling the trigger (3), the whole firing mechanism is set in motion for the purpose of initially positioning the cylinder (2), in order to align the next chamber with the barrel (7) and firing pin (29), and subsequently, release the hammer (9) to hammer the firing pin (29) which is responsible for firing the ammunition. The actuation (rotation) of the cylinder (2) is a result of linear movement of the impeller (4) converted into rotational movement by the gear (5), which, in turn, is actuated by the trigger (3). Near the end of the trigger (3) course, the cylinder (2) completes the 180°-rotation, which is necessary for the correct alignment of the next chamber. At this time, the cylinder (2) has its rotation latched by the cylinder (20) latch. The hammer (9), also pulled by the trigger (3), has not yet received enough momentum to be released to the shooting. This additional course of the trigger (3), although the cylinder (2) is already positioned and latched, is possible thanks to the mechanism, part of the cylinder (4) impeller, which comprises the following parts: actuator (28) and spring (27) (see FIG. 4B). This configuration allows the trigger course is completed (3), required to release the hammer (9), even if the linear course of the cylinder impeller (4) is prevented by the rotation locking of the cylinder (2).

Figure 4A:
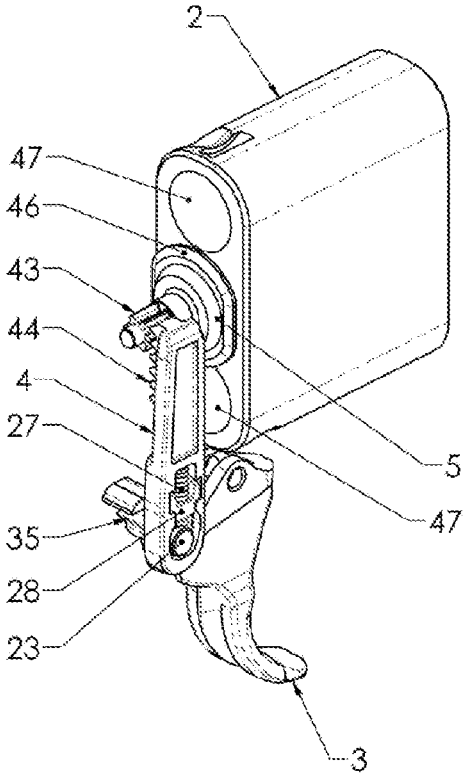
FIGS. 4A and 4B are, respectively, a perspective view illustrating the coupling of the impeller between the trigger and the cylinder, and a front elevation view illustrating an enlarged detail of the impeller.
Figure 4B:
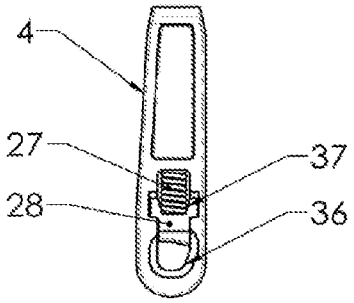

More particularly and as illustrated in FIGS. 4A and 4B, the cylinder impeller (4) has on the bottom a cradle (36) inside which is provided the impeller (23) shaft, so as to coupling the impeller (4) to the trigger (3). Said cradle (36) is defined by rigid side and bottom walls while the upper locking is obtained by the actuator (28). In addition, the cradle (36) allows a gap between the impeller (23) shaft and the actuator (28), so as to allow that the initial movement of the trigger (3) acts to initially release the cylinder stop and, in sequence, performing the rotation of said cylinder (2) by means of the gear (5). Said actuator (28) further has, at its upper end, a seat (37) which receives a spring (27). The actuator (28) is able to move longitudinally with respect to the impeller (4), but such movement is counterposed by the action of said spring (27). Therefore, the initial movement of the trigger (3) causes an elevation of the impeller (4), wherein is obtained the rotation of the cylinder without the spring (27) is compressed. When the impeller reaches its maximum displacement (up), any further movement of the trigger causes the compression of the spring (27), but not a higher elevation of the impeller (4). Thereby, it is possible to obtain such a delay between the cylinder (2) rotation and the firing of the gun.

Regress of the Mechanism

After firing, the mechanism with the spring (16) action tends to return to its starting point. As the impeller (4) is engaged to the gear (5), engaged to the ratchet (6), engaged to the cylinder (2) and locked in the latch (20), the ratchet (6), which is housed in the inner part of the cylinder (2) shaft and under the spring (30) action, performs the work of releasing the mechanism and lock again the cylinder (2), as soon as the mechanism is in its rest position, getting ready for the next actuation or firing, keeping the cylinder (2) locked in its position until its rotation is requested (see above the paragraph 0018).

Loading and Locking Ammunition

Figure 7:
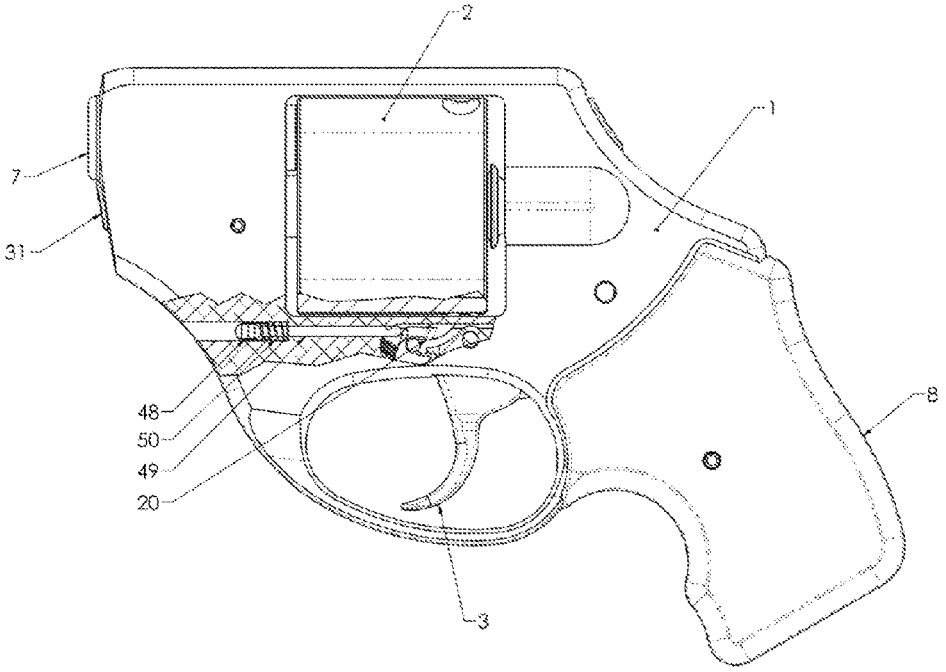
FIG. 7 is a side elevation view of the gun, partly in section, illustrating the release mechanism of the cylinder stop.

This design has no cylinder support, whose function is to make the cylinder (2) be folded away from the frame (1), in order to load and remove the ammunition. For the loading, it is necessary to push the button (48) located in the frame until the cylinder latch (20) releases the cylinder (2) enabling to move it manually up to the horizontal position, so as to allow its loading. In particular, FIG. 7 illustrates the button (48) for releasing the cylinder latch (20), which is connected to an actuation rod (49) whose front end is surrounded by a spring (50). Hence, when the button is manually pushed (to the right with respect to the view of FIG. 7), the spring (50) is compressed, the rod (49) is displaced against the forward portion of the gun and the cylinder latch (20) is released whereby the cylinder (2) can rotate freely.

Once it is performed the gun loading, the cylinder (2) is manually placed in its starting position, ensuring its locking by the cylinder latch (20). To perform the ammunition unloading, detonated or not, and as the gun has no extractor, the unloading takes place manually, making use of the same cylinder (2) position used for the gun loading.

At the moment the ammunition is placed inside the cylinder (2) and the latter is placed in its starting position (vertical), in order the mechanism can operate (as the gun has no protrusions), were developed in the gear (5), at its ends, tabs (46) (see FIG. 4A) whose function is to hold the ammunition through it basis, in order to maintain the ammunitions on their positions in the chambers, even during the cylinder rotation.

Once the actuation of the mechanism is performed by the trigger (3), for eventual firing, and as the gear (5) is set in motion by the mechanism and thus activates the cylinder (2), both rotate at same time while making the imprisonment of ammunition.

In the moment the gun loading and unloading is performed, as mentioned above, the gear (5) is in the rest position wherein only the cylinder (2) is manually rotated, thus facilitating the gun loading and unloading.

As a result of what was above described, the gun, object of the present invention, results different from usual revolvers wherein:

- it has a "SLIM" profile, without protruding portions thereof;
- the frame (1) is preferably produced in aluminum, obtained in the said profile using extrusion process, not requiring the usual forging process;
- the cylinder (2) has non-circular flat profile, obtained by drawing process;
- it does not have "ears", which function in usual model would be to prevent the ammunition exit off from the cylinder chamber;
- it does not have cylinder support, since the cylinder (2) is fixed on the frame (1) through the shaft (25) which thus allows only axial movement;
- it does not have thimble, whose function, in an usual gun, would be to release the cylinder for unloading and loading processes; and
- it has rounded corners making easy its handling and storage.

Finally, the below table shows the list of the gun component parts for a better understanding of the present invention.

TABLE 1

| Component parts | |
|---|---|
| 1 | frame |
| 2 | cylinder |
| 3 | trigger |
| 4 | cylinder impeller |
| 5 | gear |
| 6 | ratchet |
| 7 | barrel |
| 8 | grip |
| 9 | hammer set |
| 10 | elastic pin |
| 11 | trigger spring backboard |
| 12 | plate screw |
| 13 | striking bar |
| 14 | elastic pin |
| 15 | trigger spring rod |
| 16 | trigger spring |
| 17 | real spring set |
| 18 | firing pin bush |
| 19 | firing pin spring |
| 20 | cylinder latch |
| 21 | cylinder latch spring |
| 22 | striker pin |
| 23 | impeller shaft |
| 24 | mechanism plate |
| 25 | cylinder shaft |
| 26 | gear bearing |
| 27 | impeller spring |
| 28 | actuator |
| 29 | firing pin |
| 30 | spring |
| 31 | cover |
| 32 | hammer shaft |
| 33 | rod |
| 34 | trigger shaft |

TABLE 1-continued

| Component parts | |
|---|---|
| 35 | arm |
| 36 | cradle |
| 37 | seat |
| 38 | annular seat |
| 39 | longitudinal teeth |
| 40 | slope |
| 41 | central pin |
| 42 | recess |
| 43 | pinion |
| 44 | impeller tooth |
| 45 | seat |
| 46 | tab |
| 47 | chamber |
| 48 | button |
| 49 | actuation rod |
| 50 | spring |
| 51 | slope |
| 52 | central opening |
| 53 | spacer ring |
| 54 | cylinder latch shaft |

The invention claimed is:

1. A revolver with a two chambers cylinder, of the type that has a low profile and with no protruding parts from a frame, the revolver comprising the frame provided with a grip at its back portion, a trigger at its lower portion and a barrel at its front portion, the frame further comprising a central opening that defines a cylinder housing, the cylinder having an oblong shape and having two chambers radially opposite with respect to a rotation axis of the cylinder, wherein:

the trigger is provided with an arm at its front portion, an impeller shaft transversely projecting from the arm;

an impeller having the form of a longitudinal bar shaped with displacement of the vertical direction, having on the bottom a cradle, so as to receive and articulate the impeller shaft, and teeth arranged at the upper portion of the impeller able to engage the teeth of a pinion;

a gear co-axially disposed with respect to the rotation axis of the cylinder, the gear comprising at its rear portion a pinion and comprising at its front portion a pair of gear slopes inclined and radially opposite to one another and arranged internally to a divergent conical portion of the gear;

a ratchet co-axially disposed with respect to the rotation axis and inwardly disposed relative to the cylinder, the ratchet having a cylindrical shape, externally provided with longitudinal teeth for coupling in rotation, but not in longitudinal translation, with the cylinder, the end of the ratchet, facing the gear, has a pair of ratchet slopes complementary to the gear slopes; and the cylinder comprising a central longitudinal opening, from the front end of said longitudinal opening is arranged, inside the cylinder, a rotation shaft and, from the rear end of said central longitudinal opening is arranged the ratchet and wherein, between the rotation shaft and the ratchet is provided a ratchet spring.

2. The revolver according to claim 1, wherein the cradle is defined by rigid side and bottom walls, while an upper locking is obtained by an actuator, wherein the actuator also has, at its upper end, a seat which receives an impeller spring.

3. The revolver according to claim 1, wherein the ratchet has, in the inner portion of ratchet slopes, a central pin provided to enter into a corresponding center hole of the gear, and wherein the length of said central hole is larger than the relative longitudinal displacement between the ratchet and the gear, due to mechanical interference between their corresponding ratchet and gear slopes.

4. The revolver according to claim 1, wherein the frame has a through hole below the barrel to receive the cylinder rotation shaft, wherein the cylinder rotation shaft is held in position by an elastic pin, and wherein frame a through hole is frontwards closed by a fitting cover.

5. The revolver according to claim 1, wherein the revolver comprises a button disposed on at least one side of the frame, the button is connected to an actuation rod whose front end is surrounded by the gear spring and whose rear end acts on a cylinder latch.

* * * * *